US005125526A

United States Patent [19]

Sumanis

[11] Patent Number: 5,125,526

[45] Date of Patent: Jun. 30, 1992

[54] WASTE RECEPTACLE WITH INTERIOR BAG THAT IS OPENED AND CLOSED AUTOMATICALLY

[76] Inventor: Arnold J. Sumanis, W312 Fairview Dr., Mundelein, Ill. 60060

[21] Appl. No.: 795,720

[22] Filed: Nov. 21, 1991

[51] Int. Cl.[5] ..... B65D 43/26

[52] U.S. Cl. ..... 220/263; 220/404; 220/409; 220/908; 220/264

[58] Field of Search ..... 220/262, 263, 264, 908, 220/909, 403, 404, 407, 409, 410

[56] References Cited

U.S. PATENT DOCUMENTS

| | | | |
|---|---|---|---|
| 1,907,082 | 5/1933 | Meltzer | 220/404 |
| 2,946,474 | 7/1960 | Knapp | 220/263 X |
| 3,836,037 | 9/1974 | Bass | 220/404 X |
| 4,427,110 | 1/1984 | Shaw, Jr. | 220/404 X |

FOREIGN PATENT DOCUMENTS

| | | | |
|---|---|---|---|
| 888013 | 12/1971 | Canada | 220/404 |
| 550857 | 1/1943 | United Kingdom | 220/404 |

*Primary Examiner*—Stephen Marcus
*Assistant Examiner*—Paul A. Schwarz
*Attorney, Agent, or Firm*—Dressler, Goldsmith, Shore, Sutker & Milnamow, Ltd.

[57] ABSTRACT

A receptacle for receiving soiled articles including a bag which is disposed in and secured to a rotatably mounted holder. The holder is rotated to open and close the bag in response to movement of a foot pedal which opens the bag when the receptacle is opened and closes the bag when the receptacle is closed.

7 Claims, 3 Drawing Sheets

WASTE RECEPTACLE WITH INTERIOR BAG THAT IS OPENED AND CLOSED AUTOMATICALLY

BACKGROUND OF THE INVENTION

This invention relates to receptacles that contain bags to store soiled materials that give off odors, or emit dust (or other particulate matter) Such bags should be sealed off when they are not in use, but should be readily openable when additional articles are to be placed therein. Typically, receptacles containing such bags must be manually closed before the receptacle is closed by twisting the bag's open end to a sealed position and then applying a tying device to the twisted bag. When subsequent articles are to be placed therein, they have to be manually untied and opened. This is unnecessarily burdensome, time-consuming, and what usually happens in such a situation is that the bags are left open, with the result that odors or particulates will emanate therefrom. Other types of receptacles have been used wherein the tops may be designed to close off after insertion of soiled articles, such as illustrated in U. S Pat. No 4,427,110. However, in these situations, the top may not completely close, with the result that the odors emanating from the soiled articles, such as diapers, soiled uniforms, or linens containing food particles, will not be retained within the receptacle It can be appreciated that a simple receptacle device containing a bag that will automatically be opened upon opening of the receptacle for the bag to receive articles and will be automatically closed when the receptacle is closed would serve a very desirable function and thus eliminate offensive odors or the emission of dust or particulates therefrom.

SUMMARY OF THE INVENTION

In accordance with the present invention, there is provided a receptacle in which there is located a plastic bag for receiving soiled articles. The bag is fixed in position relative to the receptacle and has the lower portion thereof located in a rotatably mounted holder. The bag is adhered to the holder to insure that the bag rotates with the holder, but is readily removable therefrom. The upper portion of the bag is secured in place relative to the receptacle by an elastic band. In addition, a plurality of hooks could be disposed within the receptacle to retain a bag in position. While the embodiment illustrated discloses a relatively small receptacle for holding diapers, the receptacle can be substantially larger and can be used in nursing homes, restaurants, etc. In such event, rollers could be employed for easy portability.

The holder is rotatably mounted and is interconnected to a foot pedal, whereby when the foot pedal moves, the holder and associated bag are rotated to twist the bottom of the bag relative to the upper portion to seal off or open the lower portion of the bag containing the soiled materials. The foot pedal mechanism is interconnected to the lid and holder, whereby when the foot pedal is pressed down the lid is opened and the rotatably mounted holder is rotated to untwist the bag to the open position. When the foot pedal is released, biasing means is provided to close the lid and at the same time rotate the holder in the opposite direction to form the twist seal in the bag to seal off the interior of the bag.

As will be seen from the following drawings, there is illustrated several embodiments of the invention, but these can be modified as desired within the true spirit and scope of the invention.

DETAILED DESCRIPTION OF THE PREFERRED EMBODIMENTS

Figures 1, 2, 3, 4:
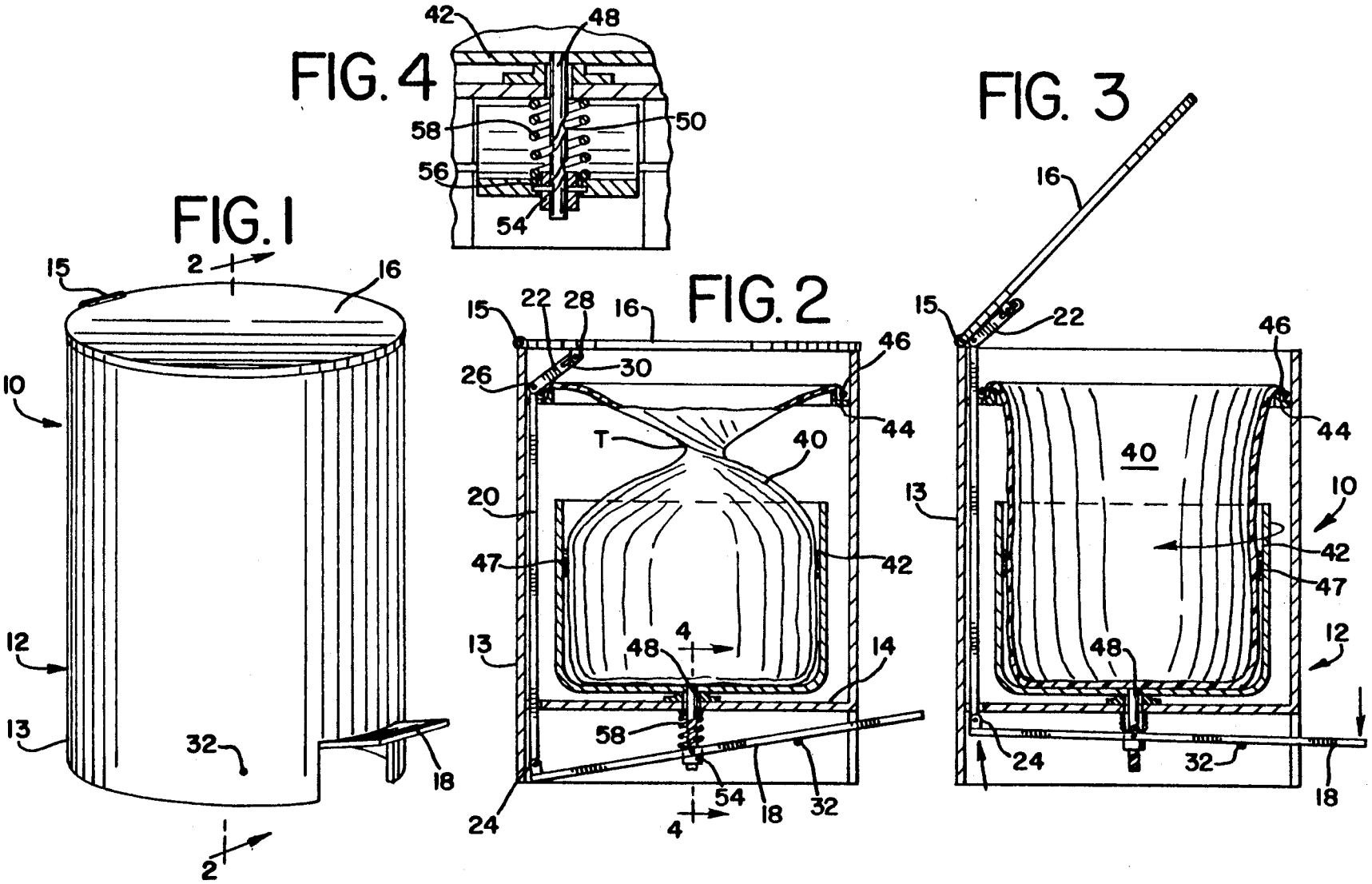
FIG. 1 shows a perspective view of the receptacle.
FIG. 2 is a cross-sectional view taken along line 2—2 of FIG. 1.
FIG. 3 is a view showing the lid of the receptacle and article receiving bag in the open position.
FIG. 4 is an enlarged view taken along line 4—4 of FIG. 2.

Referring now to FIG. 1, there is illustrated a conventional metal or plastic waste receptacle 10 consisting of a container 12 having a cylindrical sidewall 13 and a bottom wall 14 (see FIG. 2). Secured to the cylindrical sidewall 13 by hinge 15 is a lid 16. The lid 16 is moved to the open position by foot pedal 18 through the action of links 20 and 22. The link 20 is connected to foot pedal 18 by pin 24, and link 20 is connected to link 22 by pin 26. The link 22 is connected to the lid 16 by pin 28. The link 22 contains the slot 30 to provide the requisite lost motion connection to permit movement of the lid from the closed to the open position as shown in FIG. 3.

The foot pedal 18 is fulcrumed about pin 32 that is connected to the sidewall 13. Thus, downward movement of the foot pedal 18 results in opening movement of the lid 16 from the position shown in FIG. 2 to the position shown in FIG. 3 through the action of links 20,22.

In accordance with the present invention, there is provided a bag 40 disposed in a holder 42 within the container 12. The holder is rotatably mounted relative to the container 12 through the action of a cam assemblage described in detail hereinafter. Specifically, the holder 42 is rotated upon both downward and upward movement of the foot pedal 18 about the fulcrum pin 32. In order to insure that the bag is rotated with the holder, a double sided adhesive tape 47 is provided to secure the bag 40 to the holder 42, and such tape also permits ready removal of the bag from the holder when it is desired to dispose of the bag and its contents. In order to fix the bag in position relative to the container, the open end of the bag is disposed over an annular ring 44 secured to the upper portion of the sidewall 13 of the container. To affix the upper portion of the bag in position, an elastic band 46 is provided to positively secure the upper end of the bag relative to the annular ring.

As aforementioned, the essence of the invention consists of providing a bag that is fixed in position relative to a holder and when the holder is rotated, the bag 40 is moved to the open or closed position, depending on the position of the foot pedal and associated lid. Thus, as shown in FIG. 2, when the lid is closed, the holder has been rotated to form a twist seal T between the upper and lower portions of the bag. When it is desired to place soiled diapers, uniforms, linens, etc., or asbestos-laden articles, or the like, into the bag, the foot pedal is depressed, which results in opening the lid of the receptacle, and at the same time rotating the holder to open the bag to receive additional articles. The position of the various mechanisms when the container is opened is shown in FIG. 3.

In order to accomplish the rotating action, reference now is made to FIG. 4, which shows an enlarged view of the connection between the foot pedal and the holder. Specifically, the holder 42 has secured to the bottom thereof a pin 48 wherein there is provided a cam track 50. The pin 48 extends into a pivotally mounted socket 54 which allows the socket to pivot relative to the foot pedal, so that when the foot pedal moves, the socket 54 will move vertically, even though the foot pedal is operating through a slight arc. Included within the interconnection between the foot pedal 18, socket 54, and pin 48, is a follower pin 56 that moves up the track 50 when the foot pedal is moved downwardly between the positions shown in FIG. 2 and FIG. 3. As the pin 56 moves upwardly through the track 50, the pin 48 and thus the holder 42 is rotated to form the untwisting action of the twist T to open the bag to receive additional soiled articles. When the foot pedal is released, compression spring 58 is provided to force the foot pedal 18 back to the position shown in FIG. 2, during which action the holder is rotated in the opposite direction to retwist the bag to seal off its interior. During this same action, the lid 15 is closed to close off the receptacle. Thus, after an article has been placed in the bag and the foot pedal released, the bag will be sealed off and the container closed to prevent odors or particulates from escaping from the receptacle.

Figure 6:
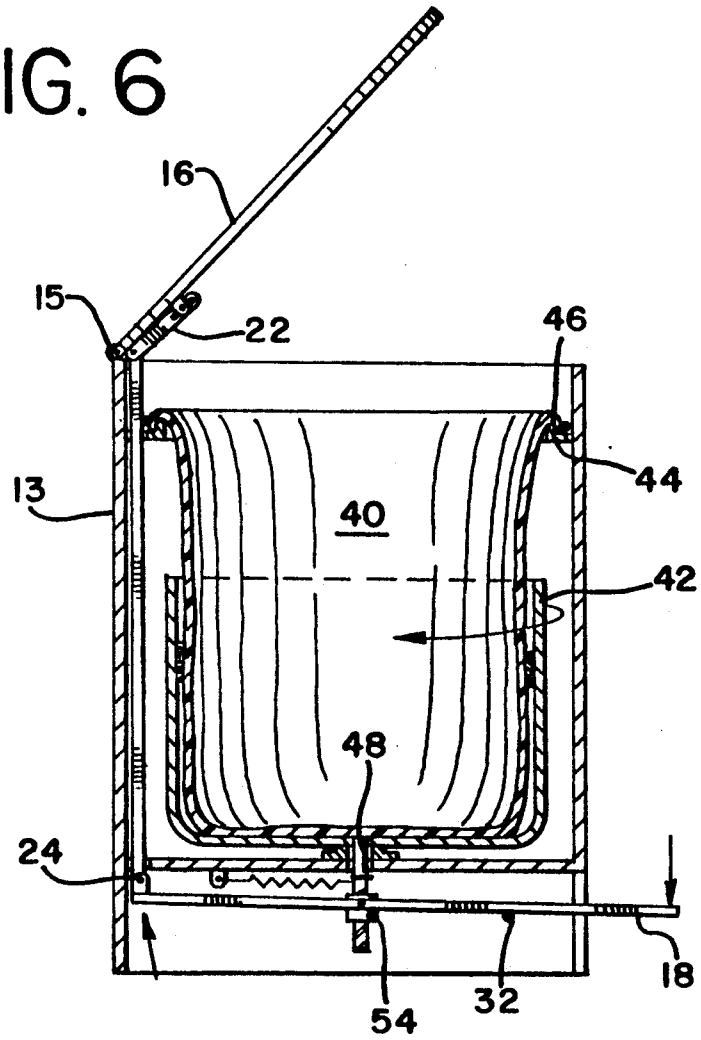
FIG. 6 is a view similar to FIG. 5 showing the receptacle and bag in the open position.
Figure 5:
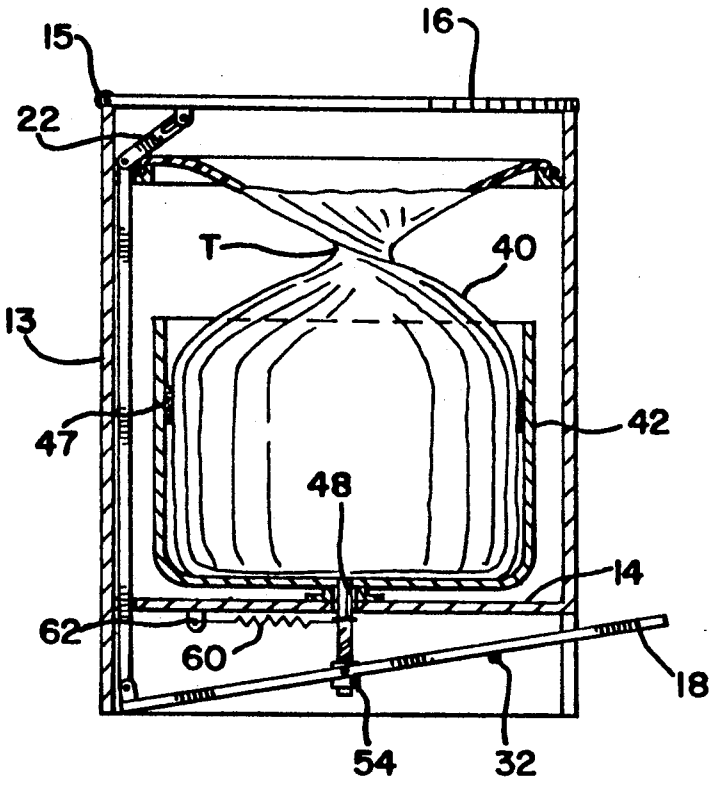
FIG. 5 illustrates a second embodiment of the invention.

Referring now to FIGS. 5 and 6, there is shown an embodiment similar to that shown in FIGS. 1–4, but instead of the compression spring, there is illustrated a tension spring 60 which is secured at one end to a bracket 62 secured to the bottom wall 14 of the receptacle and at its other end to the pin 48. Thus, when the foot pedal is pressed down to open the lid 16, the pin 48 is moved to rotate the holder and untwist the bag, during which time the spring 60 winds around the rod 48. When the foot pedal is released, the action of the spring 60 rotates the rod and holder in the opposite direction to twist and seal the bag, as discussed with respect to the first embodiment.

Figure 9:
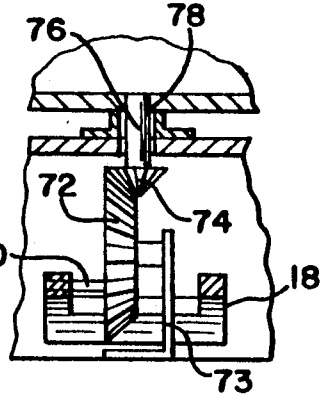
FIG. 9 is a view taken along line 9—9 of FIG. 8.

A further embodiment is illustrated in FIG. 9. In this embodiment, a bevel gear arrangement is used to rotate the bag between its open and closed position. Since this embodiment differs from those disclosed in FIGS. 1–6 only in the area of the mechanism employed for rotating the bag between its open and closed positions, the description will be limited to this portion of the receptacle.

Figure 8:
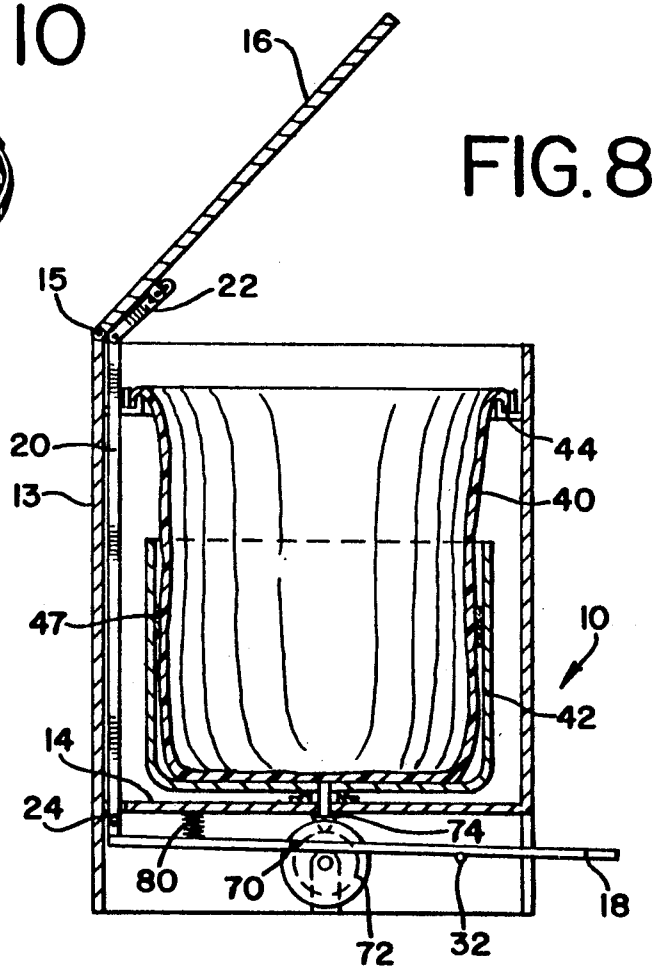
FIG. 8 is a view similar to FIG. 7 showing the lid of the receptacle and article receiving bag in the open position.
Figure 7:
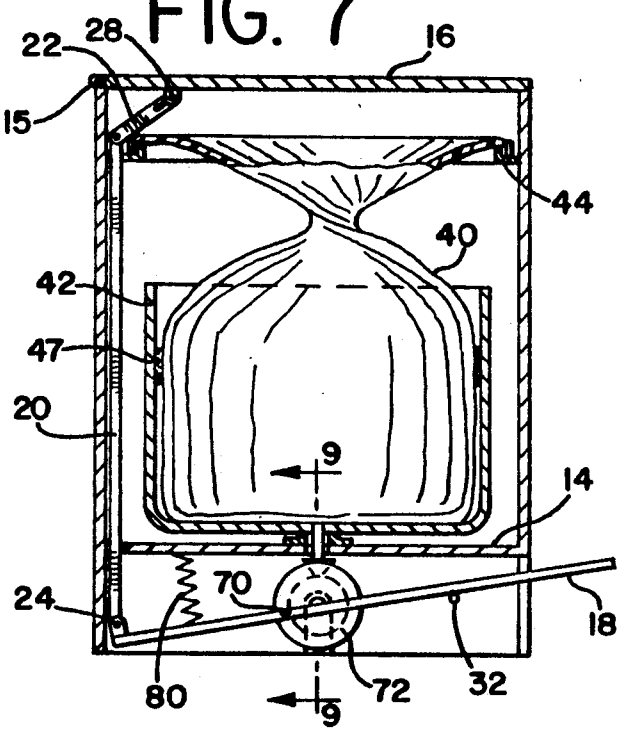
FIG. 7 illustrates a third embodiment of the invention.

Specifically, the foot pedal 18 is connected to the link 20 by pin 24 and is fulcrumed about fulcrum pin 32 that is connected to the sidewall 13. The pedal 18 is connected at an intermediate section by a pin 70 to bevel gear 72. Gear 72 is rotatably supported by a bracket 73 that is suitable connected to the receptacle (not shown). The mating bevel gear 74 includes a shaft 76 that is press-fitted into an opening 78 in the bottom of holder 42. Thus, rotation of the gear 74 will move the holder 72 between the closed bag position shown in FIG. 7 and the open position shown in FIG. 8, and vice versa. A compression spring 80 disposed between the receptacle bottom wall 14 and pedal 18 positions the bevel gear to maintain the bag closed as shown in FIG. 7. When the pedal 18 is engaged, the gears 72,74 are rotated to move the bag to the open position as shown in FIG. 8. The gear ratio between bevel gear 72,74 can, by way of example only be on the order of 10 to 1 to insure that a relatively small rotation of gear 72 will rotate gear 74 the desired amount to provide for the requisite opening and closing of bag 40.

Figure 10:
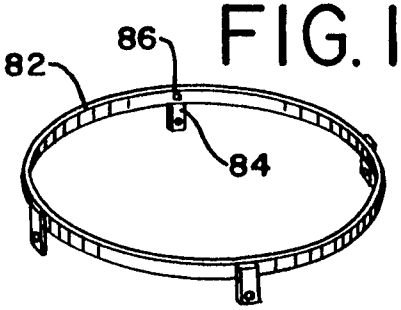
FIG. 10 is a perspective view of a ring that can be used to hold a bag in position within the receptacle.

In FIG. 10, there is illustrated a ring assemblage 82 having depending tabs 84 that can be used to fix the bag in position relative to the container in place of the elastic band 46 illustrated in FIG. 2. A bag 40 is affixed to the ring 82 by the tabs 84 that are folded over to retain the bag against the ring by engaging the snaps 86. The ring assemblage 82 including the open end of bag 40 is then placed within the annular ring 44.

While a double-sided adhesive tape has been used to secure the bag to the holder, an elastic band employed to affix the bag to the container, and a particular holder rotating mechanism has been illustrated, various other constructions can be used to accomplish these functions. In addition, the size and shape of the receptacle illustrated is by way of example only and can be square, octagonal, etc., and whatever size desired. Similarly, while a top opening receptacle has been illustrated, the invention is not so limited since a side opening is within the scope of the invention so long as the bag is opened in response thereto.

It is, of course, intended to cover all such modifications that fall within the true spirit and scope of the invention.

What is claimed is:

1. A receptacle for receiving soiled articles comprising a container having an upper opening, a lid pivotally mounted to the container by a hinge to open and close said upper opening, means including a foot lever pivotally mounted to the container at the lower portion thereof, and linkage means interconnecting said foot lever and lid for moving said lid between open and closed positions, a holder in said container, an open ended bag removably connected to said holder, means for securing the open end of said bag to said container and means interconnecting said holder and said foot lever for rotating said holder relative to said container upon pivotal movement of said foot lever, whereby when the lever is operated to move the lid to the open position, the holder is rotated in one direction to open the bag to receive soiled articles, and biasing means acting to move the foot pedal to close the lid and rotate the holder in the opposite direction to close the bag when the foot pedal is released.

2. A receptacle as set forth in claim 1 wherein the opening of the receptacle is at the top thereof and the means for interconnecting and rotating said holder and said foot lever includes a cam assemblage interconnecting said foot pedal and said holder.

3. A receptacle as set forth in claim 2 wherein said cam assembly includes a pin connected to said holder, which pin defines a cam track, and cam follower means secured to said foot pedal whereby movement of said foot pedal turns said pin to rotate the holder to move the bag between its open and closed positions during its respective opening and closing of the lid of said container.

4. A receptacle as set forth in claim 1 in which the bag is removably secured to said holder by a double-sided adhesive tape.

5. A receptacle as set forth in claim 1 in which the container has an annular rim secured to its inner upper end and the open end of the bag is retained in position relative to the rim by an elastic band.

6. A receptacle as set forth in claim 1 in which the container has an annular rim assembly secured to its inner upper end and the open end of the bag is retained in position relative to the rim assembly by a snap ring assemblage secured to the open end of the bag which assemblage is disposed in said annular rim assembly.

7. A receptacle as set forth in claim 1 in which the means interconnecting and rotating said holder and said foot lever comprises a gear assembly.

* * * * *